US006102461A

United States Patent [19]

Rooney et al.

[11] Patent Number: 6,102,461

[45] Date of Patent: Aug. 15, 2000

[54] FRAME HANDLE

[75] Inventors: Kevin Rooney, Minneapolis, Minn.; Ranjiv Goonetilleke, Long Beach, Calif.

[73] Assignee: Target Brands, Inc., Minneapolis, Minn.

[21] Appl. No.: 09/182,071

[22] Filed: Oct. 29, 1998

[51] Int. Cl.[7] ..... A47G 1/16

[52] U.S. Cl. ..... 294/142; 248/497; 40/719

[58] Field of Search ..... 294/137, 138, 294/142, 145, 165, 166; 248/475.1, 489, 497, 682, 684, 690, 251; 40/719, 757, 758, 759

[56] References Cited

U.S. PATENT DOCUMENTS

| | | | |
|---|---|---|---|
| 175,723 | 4/1876 | McGill . | |
| 1,911,314 | 5/1933 | Gunkel | 294/137 |
| 1,914,951 | 6/1933 | Kiessling . | |
| 2,686,641 | 8/1954 | Friedrich | 248/30 |
| 2,723,816 | 11/1955 | Drysdale | 248/497 |
| 3,301,452 | 1/1967 | Jester | 224/45 |
| 3,865,342 | 2/1975 | Kanzelberger | 40/757 |
| 4,248,000 | 2/1981 | Greenbaum | 40/719 |
| 4,446,968 | 5/1984 | Bremer | 206/451 |
| 4,458,873 | 7/1984 | Sutherland | 40/759 |
| 5,048,788 | 9/1991 | Lorincz | 248/477 |
| 5,326,147 | 7/1994 | Watson | 294/162 |
| 5,342,014 | 8/1994 | Wilson | 248/497 |

FOREIGN PATENT DOCUMENTS

| | | | |
|---|---|---|---|
| 127944 | 4/1950 | Sweden | 294/142 |
| 6709 | of 1910 | United Kingdom | 294/142 |

OTHER PUBLICATIONS

Photo of a product using a hanging display device, No Date.

*Primary Examiner*—Dean J. Kramer
*Attorney, Agent, or Firm*—Jeffer, Mangels, Butler & Marmaro LLP

[57] ABSTRACT

A handle for supporting an object. The handle includes a main body portion having a hanger opening defined therein, and a protection member extending forwardly from the main body portion. The main body of the handle also includes a support portion that partially defines the hanger opening and extends above the protection member. The support portion defines a plurality of spaced apart notches that form a portion of the hanger opening and a plurality of arcuate flanges extending therefrom that each correspond to one of the plurality of notches.

12 Claims, 3 Drawing Sheets

FIG. 3
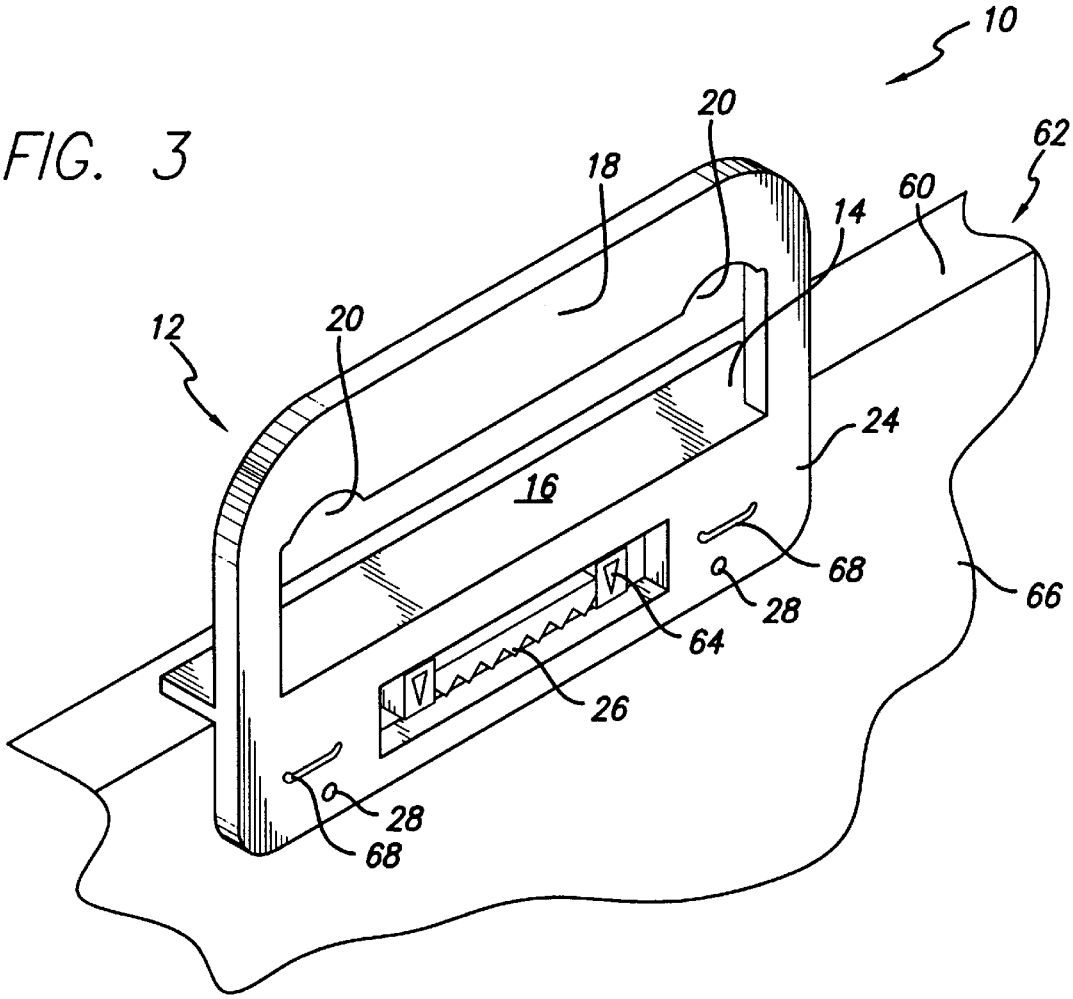
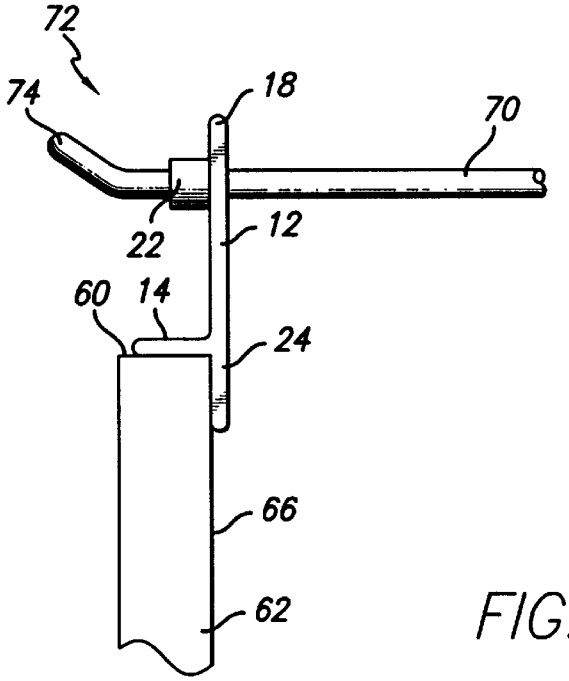
FIG. 4

FIG. 5
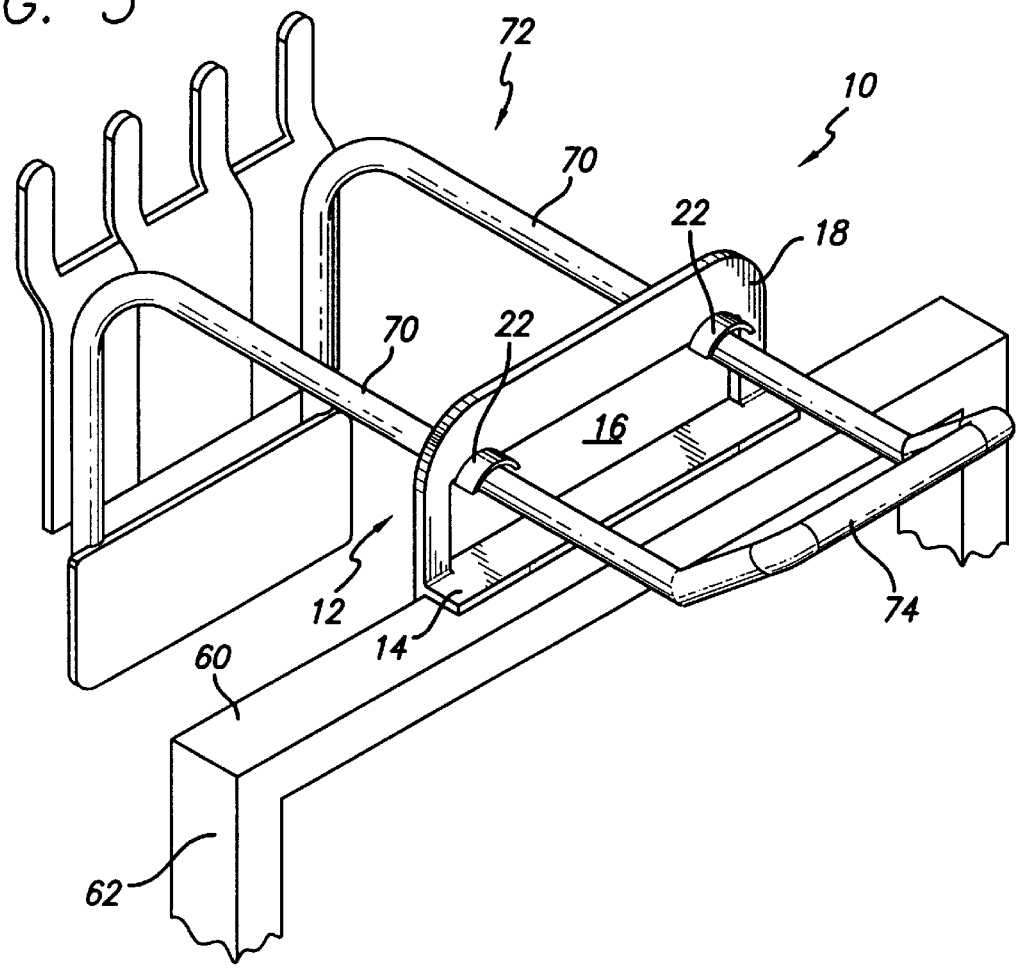
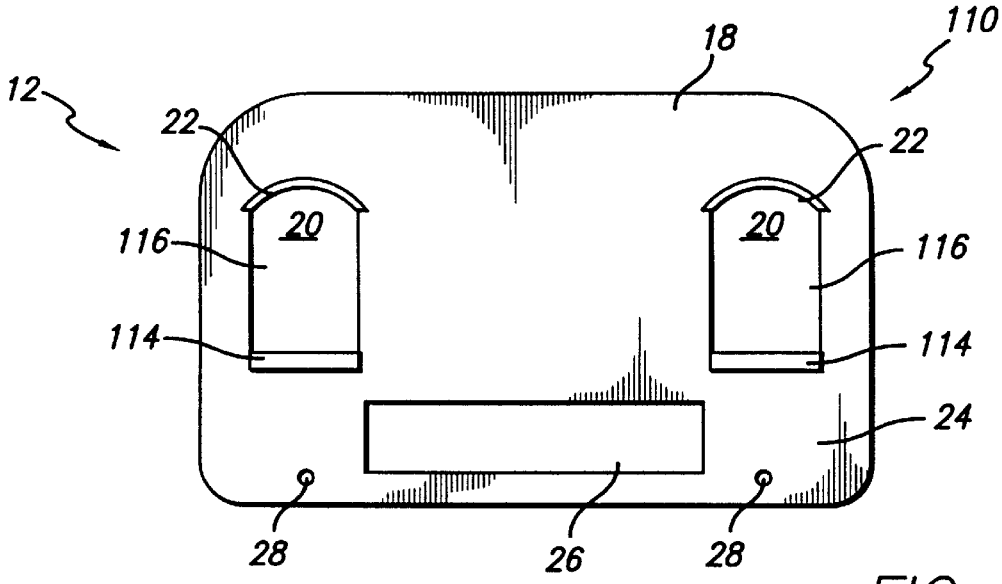
FIG. 6

FRAME HANDLE

FIELD OF THE INVENTION

The present invention relates to a handle for displaying objects, such as framed art.

BACKGROUND OF THE INVENTION

When a retail store sells framed art the frames are often displayed on shelves. However, many disadvantages are inherent in displaying the frame on shelves. First of all, shelves cast shadows. Because the lighting comes from the ceiling, the consumer only sees the frames on the top shelf clearly, and the frames on the lower shelves have a "shelf shadow" cast on them by the shelf thereabove. Because the framed art on the lower shelves is difficult to see it may not "catch the eye" of a consumer, thereby making sales more difficult. Secondly, there is a fixed area between shelves in which to display the framed art. It is desirable to use all of this space. However, once a shelf height is established, all of the shelves down the entire aisle are set at the same height. This creates a space problem when there are frames of different heights. For example, if the distance between shelves is 2.0 ft. and a frame that is 1.0 ft. tall by 1.0 ft. wide is placed on the bottom shelf, there is 1.0 $ft^2$ of space that is lost. As a result, a store may lose upwards of 40% of display space in the framed art department.

A need exists for a device for displaying framed art that allows the seller to maximize the display area and the consumer to view the framed art without "shelf shadows."

Hangers for displaying framed art are known. Serrated wall hooks, are often used for hanging framed art from a wall. An example of such a device is shown in U.S. Pat. No. 5,048,788 to Lorincz. Wires and hooks can also be used for hanging frames. However, these devices are not advantageous for retailers that desire to display multiple copies of the same piece of art behind one another.

Hangers that comprise a loop or handle that extends above the frame for hanging on a nail, peg or the like are also known. Such devices have been used to display other item. For example, toilet seats being displayed for sale in a store. An example of such a device for use with frames is shown in U.S. Pat. No. 1,914,951 to Kiessling. There are many disadvantages inherent in the use of such a device. For example, the nail, rod or other object that extends through the hanger can damage the top of the frame. The single point from which the frame hangs can cause the frame to pivot and rock about that point. Also, the hangers are not easily removable from the frame. Other devices for hanging or holding objects are taught in U.S. Pat. No. 5,326,147 to Watson, U.S. Pat. No. 4,446,968 to Bremer, U.S. Pat. No. 3,301,452 to Jester, U.S. Pat. No. 2,686,641 to Friedrich, and U.S. Pat. No. 175,723 to McGill.

A need exists for a device for displaying framed art that overcomes the aforementioned disavantages of the prior art.

SUMMARY OF THE PREFERRED EMBODIMENTS

In accordance with one aspect of the present invention there is provided a handle for supporting an object, the handle including a main body portion having a hanger opening defined therein and a protection member extending forwardly from the main body portion.

In accordance with another aspect of the present invention there is provided a handle for supporting an object and a frame having a top surface and a rear. The handle includes a main body portion having a hanger opening defined therein and a protection member extending forwardly from the main body portion. The protection member extends above the top surface of the frame and the main body portion is affixed to the frame.

In accordance with yet another aspect of the present invention there is provided a handle and a peg hook that includes a pair of rods forming a loop at their distal end. The handle includes a main body portion having a hanger opening defined therein and a protection member extending forwardly from the main body portion. The peg hook extends through the hanger opening.

In accordance with a further aspect of the present invention there is provided a handle for supporting an object, the handle including a main body portion having a hanger opening defined therein. The main body portion includes a support portion that partially defines the hanger opening and also defines at least one notch that forms a portion of the hanger opening and is adapted to receive a rod.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which

FIG. 3 is a perspective view of the frame handle of FIG. 1 affixed to a frame showing a serrated wall hook disposed in the opening.

FIG. 4 is a partial side elevation showing the frame handle of FIG. 1 affixed to the top of a frame and hanging from a peg hook.

FIG. 5 is a perspective view of the frame handle of FIG. 1 affixed to the a frame and hanging from a peg hook.

FIG. 6 is a front elevation of a frame handle in accordance with an alternative embodiment of the present invention having a plurality of hanger openings and protection members.

Like numerals refer to like parts throughout the several views of the drawings.

DETAILED DESCRIPTION OF THE PREFERRED EMBODIMENTS

Figure 1:
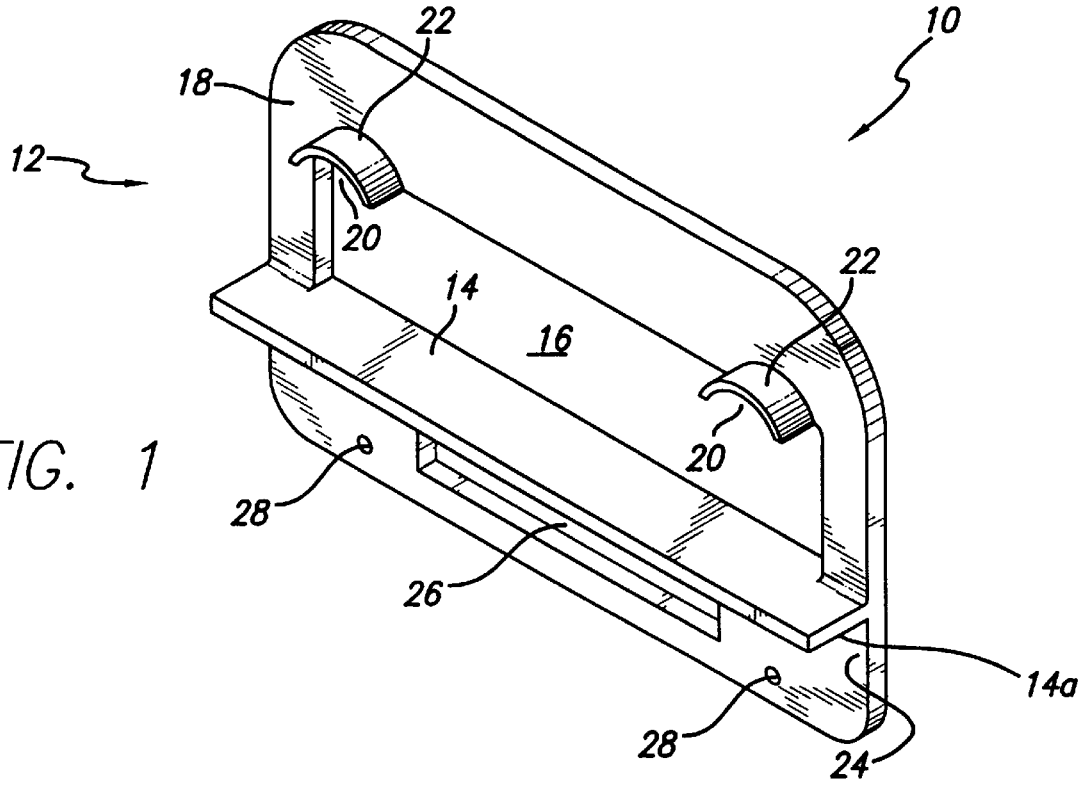
FIG. 1 is a perspective view of a frame handle in accordance with a preferred embodiment of the present invention.

Referring to FIGS. 1–5, a preferred embodiment of a handle 10 for hanging framed art or the like is shown. For exemplary purposes only the handle will be described herein as supporting framed art. However, it will be understood that this is not a limitation on the present invention and that the handle can be used to support any number of objects. For example, the handle can be used with corkboards, chalkboards, or other objects that can be advantageously displayed by hanging. The handle 10 generally includes a main body portion 12 having a hanger opening 16 defined therein, and a protection member 14.

It will be appreciated that terms such as "above," "forwardly," and "below" used hereinbelow are merely for ease of description and refer to the orientation of the components as shown in the Figures. It should be understood that any orientation of handle 10 described herein is within the scope of the present invention.

In a preferred embodiment, the main body portion 12 has a generally flat, rectangular shape. Protection member 14 extends forwardly from main body portion 12, preferably at an approximately right angle. Preferably, protection member 14 is a thin sheet or flange that extends from main body portion 12 and is adapted to protect a top surface 60 of a frame 62 from a rod 70, peg, nail or similar object for hanging objects (described more fully below). In a preferred embodiment, protection member 14, partially defines hanger opening 16. Preferably, protection member 14 is flat, however, it can be curved or conform to the shape of the top surface of the frame with which it will be used.

Extending above protection member 14 is a support portion 18. Support portion 18 partially defines hanger opening 16, as shown in the Figures. Support portion 18 also has defined therein at least one notch 20 that forms a part of hanger opening 16. In a preferred embodiment, support portion 18 defines a pair of spaced apart notches 20. The notches 20 are adapted to receive a rod and can be dimensioned according to the rod from which they will be hung. In this particular embodiment, handle 10 defines two notches 20 to provide stability by preventing the frame 62 from pivoting (or rocking) side to side, as is common when an object is hung from a single rod. However it should be understood that handle 10 can define any number of notches 20.

Figure 2:
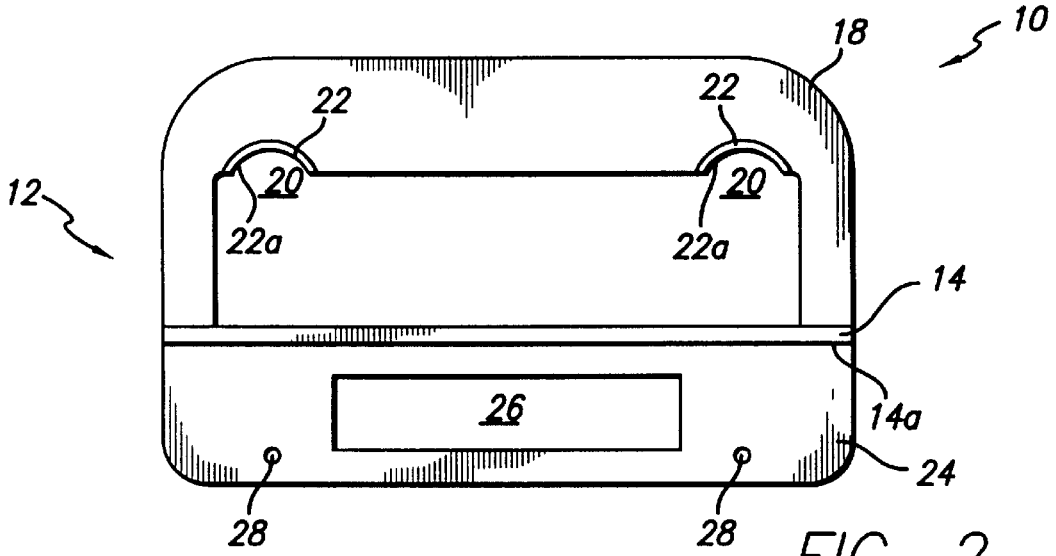
FIG. 2 is a front elevation of the frame handle of FIG. 1.

Extending from support portion 18 is at least one arcuate flange 22. Preferably, arcuate flange 22 extends forwardly. However, arcuate flange 22 can also extend rearwardly. Each arcuate flange 22 corresponds to one notch 20, as best shown in FIG. 2. The flanges 22 are configured such that the bottom, concave surface 22*a* of each flange 22 is adapted to engage rod 70, such that rod 70 is received by notch 20 and supports arcuate flange 22. The flanges 22 provide a greater amount of surface area (than if the flanges were omitted) over which to spread the weight of the frame 62 and the handle 10, thereby adding stability and reducing the occurrence of frame 62 "rocking" forwardly and backwardly while on display.

The portion of the main body portion 12 that extends below the protection member 14 is the attachment portion 24. Preferably, attachment portion 24 has defined therein an opening 26 that is provided to allow the handle 10 to fit over a serrated wall hook 64 (see FIG. 3) or similar frame hanging mechanism.

For relatively light frames, the frame handle 10 is affixed to frame 62 by stapling attachment portion 24 to the back 66 of frame 62, such that protection member 14 extends over the top surface 60 of frame 62. The staples 68 can be applied with a conventional hydraulic stapler or the like. In a preferred embodiment, attachment portion 24 defines at least one screw hole 28. Screw holes 28 are provided for use with heavier frames. For example, in a situation where staples are not strong enough to support the weight of the frame, screws or other threaded fastening means can be slipped through screw hole(s) 28 and threaded into the back of the frame, thereby providing extra support. Alternatively, other means for affixing said handle 10 to frame 62 can be employed. For example, nails, bolts, tacks, VELCRO™, adhesives and the like can be employed. In a preferred embodiment attachment portion 24 defines a pair of screw holes 28 spaced on opposite sides of opening 26.

The elements of the handle 10 (the main body portion 12, including the attachment portion 24 and the support portion 18, and the protection member 14) preferably are comprised of a plastic such as polypropelene, nylon or a phenolic resin. However, it is also within the scope of the present invention to construct the handle 10 of a metal such as aluminum, stainless steel or the like. Also, the handle 10 can be formed as one continuous piece, or two or more separate elements can be attached to one another by a conventional attachment method such as gluing, welding or the like.

Handle 10 is preferably removably affixed to frame 62 by positioning handle 10 adjacent the top center of frame 62 such that attachment portion 24 extends along and is adjacent the back 66 of frame 62, serrated wall hook 64 is received in opening 26 and the bottom surface 14*a* of protection member 14 is adjacent the top surface 60 of frame 62. Staples 68 are then stapled through the attachment portion 24 and into the back 66 of frame 62, thereby affixing handle 10 thereto. Alternatively, screws or the like can be slipped through screw holes 68 and threaded into the back 66 of frame 62.

To display frame 62, handle 10 is placed on a peg hook 72, such that peg hook 72 extends through hanger opening 16. Peg hook 72 preferably includes two rods 70 and a connection loop 74 at the exposed end of the rods 70 that is directed upwardly at an angle (see FIG. 5). Preferably, handle 10 is dimensioned such that the notches 20 are spaced apart so as to correspond to the distance between the rods 70. In other words, as the peg hook 72 extends through hanger opening 16, each rod 70 is received by a notch 20 such that the bottom surface 22*a* of the corresponding arcuate flange 22 rests on the top surface of the rod 70, thereby supporting the handle 10 (and frame 62). The rods 70 are connected to one another by connection loop 74 to prevent the rods 70 from pivoting about the end affixed to the wall, thereby adding stability to peg hook 72. Also, connection loop 74 is preferably turned up to prevent handle 10 from falling off peg hook 72.

Opening 16 is dimensioned such that connection loop 74 can fit therethrough. However, in an alternative embodiment, as shown in FIG. 6, main body portion 12 of handle 110 has defined therein a plurality of openings 116 (including notches 20) for use with rods that do not include a connection loop. In this particular embodiment, main body portion 12 can include a plurality of protection members 114 (see FIG. 6) extending therefrom, each protection member 114 being adjacent an opening 116. Any number of openings 11 6 and corresponding protection members 114 are within the scope of the present invention. For example, one center opening 116 with a single notch 20 and corresponding protection member 114 can be provided.

It will be understood that the protection members 14, 114 protect the top surface 60 of frame 62 from rods 70. Often when a person places a handle and frame back on the peg hook they may accidentally hit the top of the frame against the peg. Also, after being placed on the peg, the frame may swing and rock, thereby causing the peg to possibly come into contact with the top of the frame, thereby causing damage. The protection member 14, 114 helps prevent this damage from occurring.

The embodiments of the present invention recited herein are intended to be merely exemplary and those skilled in the art will be able to make numerous modifications to them without departing from the spirit of the present invention.

For example, the notches 20, protection member 14 or arcuate flanges 22 can be omitted. Handle 10 can have only one opening 116, notch 20 or arcuate flange 22. Opening 26 or screw holes 28 can be omitted. Support portion 18 can be a separate piece that is affixed to the attachment portion 24. Instead of being removably affixed, handle 10 can be permanently affixed using glue, epoxy or the like. A staple or other means for attachment can be extended through the protection member 14 and into the top surface 60 of the frame 62. The support portion 1 8 can be arcuate or any other advantageous shape. All such modifications are intended to be within the scope of the present invention as defined by the claims appended hereto.

What is claimed is:

1. A handle for supporting an object, said handle comprising:

(a) a main body portion having a hanger opening defined therein, and (b) a protection member extending forwardly from said main body portion, wherein said main body portion includes a support portion partially defining said hanger opening and extending above said protection member, wherein said support portion has a bottom edge and includes at least one flange extending above said hanger opening, said flange being flush with said bottom edge of said support portion.

2. The handle of claim 1 wherein said main body portion further defines an opening spaced below said protection member.

3. The handle of claim 1 wherein said support portion defines at least one notch, said notch being formed in said bottom edge of said support portion and being adapted to receive a rod.

4. The handle of claim 1 wherein said support portion defines a plurality of spaced apart notches, said notches being formed in said bottom edge of said support portion and each being adapted to receive a rod.

5. The handle of claim 1 wherein said at least one flange is arcuate.

6. The handle of claim 5 wherein said main body portion further defines at least one aperture being adapted to receive a fastener for attachment to an object.

7. The handle of claim 1 wherein said at least one flange extends forwardly therefrom.

8. A handle in combination with an object, said handle comprising:

a main body portion having a hanger opening defined therein, and a protection member extending forwardly from said main body portion wherein said main body portion includes a support portion partially defining said hanger opening and extending above said protection member, wherein said support portion includes at least one flange extending above said hanger opening, and said object comprising a frame having a top surface and a rear, and means for affixing said handle to said frame, wherein said protection member extends above said top surface of said frame, and wherein said main body portion is affixed to said frame by said means for affixing said handle to said frame.

9. A handle in combination with a peg hook, said handle comprising a main body portion having a hanger opening defined therein, and a protection member extending forwardly from said main body portion wherein said main body portion includes a support portion partially defining said hanger opening and extending above said protection member, wherein said support portion includes at least one flange extending above said hanger opening, and said peg hook including a pair of rods and a connection loop, wherein said peg hook extends through said hanger opening.

10. A handle for supporting an object, said handle comprising:

a main body portion having a hanger opening defined therein, said main body portion having a support portion rigidly connected thereto, said support portion partially defining said hanger opening and defining a plurality of notches, said plurality of notches forming a portion of said hanger opening and each being adapted to receive a rod, wherein said support portion comprises a plurality of arcuate flanges extending forwardly therefrom, said plurality of arcuate flanges each corresponding to one of said plurality of notches.

11. A handle for hanging framed art from a peg hook including a pair of rods and a connection loop, said handle comprising:

(a) a main body portion having a hanger opening defined therein, and (b) a protection member extending forwardly at an approximately right angle from said main body portion and partially defining said hanger opening, wherein said main body portion comprises (i) a support portion extending above said protection member and partially defining said hanger opening, wherein said support portion has defined therein a pair of spaced apart notches each forming a portion of said hanger opening, and wherein said support portion comprises a pair of spaced apart arcuate flanges extending forwardly therefrom, said pair of arcuate flanges each corresponding to one of said pair of notches, and (ii) an attachment portion extending below said protection member and having defined therein an opening for receiving a serrated wall hook and a pair of screw holes spaced on opposite sides of said opening.

12. A handle for supporting an object in combination with a peg hook, said handle comprising:

(a) a main body portion having a hanger opening defined therein, and (b) a protection member extending forwardly from said main body portion, said peg hook comprising a pair of rods and a connection loop, wherein said peg hook extends through said hanger opening.

* * * * *